US009655485B2

(12) United States Patent
Staf

(10) Patent No.: US 9,655,485 B2
(45) Date of Patent: May 23, 2017

(54) VACUUM CLEANER SUCTION NOZZLE WITH HEIGHT ADJUSTMENT AND BLEED VALVE

(71) Applicant: Aktiebolaget Electrolux, Stockholm (SE)

(72) Inventor: Håkan Staf, Stockholm (SE)

(73) Assignee: Aktiebolaget Electrolux (SE)

( * ) Notice: Subject to any disclaimer, the term of this patent is extended or adjusted under 35 U.S.C. 154(b) by 584 days.

(21) Appl. No.: 14/132,938

(22) Filed: Dec. 18, 2013

(65) Prior Publication Data

US 2015/0164294 A1 Jun. 18, 2015

(51) Int. Cl.

| | |
|---|---|
| ***A47L 9/04*** | (2006.01) |
| ***A47L 9/00*** | (2006.01) |
| ***A47L 5/34*** | (2006.01) |

(52) U.S. Cl.

CPC ..... *A47L 9/0072* (2013.01); *A47L 5/34* (2013.01)

(58) Field of Classification Search

None

See application file for complete search history.

(56) References Cited

U.S. PATENT DOCUMENTS

| | | | |
|---|---|---|---|
| 2,032,756 | A | 3/1936 | Karlström |
| 2,107,571 | A | 2/1938 | Kirby |
| 2,683,276 | A | 7/1954 | Olsen |
| 2,904,816 | A | 9/1959 | Skolfield |
| 2,904,817 | A | 9/1959 | Brennan |
| 2,915,774 | A | 12/1959 | Darrow |
| 3,172,743 | A | 3/1965 | Kowalewski |
| 3,745,965 | A | 7/1973 | Ljung |
| 3,908,220 | A | 9/1975 | Adamson |
| 4,167,801 | A | 9/1979 | Erbor |
| 4,225,999 | A | 10/1980 | Martinec |
| 4,294,595 | A | 10/1981 | Bowerman |
| 4,307,485 | A | 12/1981 | Dessig |
| 4,437,205 | A | 3/1984 | Koland |
| 4,467,495 | A | 8/1984 | Fish |
| 4,953,253 | A | 9/1990 | Fukuda |
| 5,054,157 | A | 10/1991 | Werner |
| 5,134,750 | A | 8/1992 | King |

(Continued)

FOREIGN PATENT DOCUMENTS

JP H09 224883 * 2/1997 ..... A47L 5/30

OTHER PUBLICATIONS

GB Examination Report for GB Application No. 1422045.3, dated Apr. 18, 2016.

*Primary Examiner* — Joseph J Hail
*Assistant Examiner* — Brian Keller
(74) *Attorney, Agent, or Firm* — RatnerPrestia

(57) ABSTRACT

A vacuum cleaner nozzle assembly having an inlet opening, a height adjustment mechanism configured to adjust a vertical position of the inlet opening relative to a surface to be cleaned, a suction passage fluidly connected to the inlet opening, a bypass opening fluidly connected to the suction passage, and a bleed valve. The bleed valve has a closed position in which the bleed valve blocks the bypass opening, and an open position in which the bleed valve does not block the bypass opening to allow a flow of air through the bypass opening and into the suction passage. The bleed valve is configured to move from the closed position to the open position in response to an adjustment of the height adjustment mechanism.

20 Claims, 10 Drawing Sheets

(56) References Cited

U.S. PATENT DOCUMENTS

| | | | | |
|---|---|---|---|---|
| 5,609,024 | A | 3/1997 | Fujiwara | |
| 5,893,195 | A | 4/1999 | Jung | |
| 6,018,845 | A | 2/2000 | Sueki | |
| 6,081,963 | A | 7/2000 | Jailor | |
| 6,168,641 | B1 | 1/2001 | Tuvin | |
| 6,370,728 | B1 | 4/2002 | Burns | |
| 6,502,277 | B1 | 1/2003 | Petersson | |
| 6,829,804 | B2 | 12/2004 | Sepke | |
| 7,163,568 | B2 | 1/2007 | Sepke | |
| 7,228,592 | B2 | 6/2007 | Hawkins | |
| 7,246,407 | B2 | 7/2007 | Park | |
| 7,266,861 | B2 | 9/2007 | Stein | |
| 7,278,181 | B2 | 10/2007 | Harris | |
| 7,293,326 | B2 | 11/2007 | Hawkins | |
| 7,437,799 | B2 | 10/2008 | Rocke | |
| 7,441,306 | B2 | 10/2008 | Kim | |
| 7,441,307 | B2 | 10/2008 | Smith | |
| 7,526,834 | B2 | 5/2009 | Coleman | |
| 7,634,836 | B2 | 12/2009 | Lee | |
| 7,662,200 | B2 | 2/2010 | Knuth | |
| 7,770,257 | B2 | 8/2010 | Kim | |
| 7,814,612 | B2 | 10/2010 | Sepke | |
| 7,861,368 | B2 | 1/2011 | Hackwell | |
| 7,945,988 | B2 | 5/2011 | Gordon | |
| 7,951,214 | B2 | 5/2011 | Menrik | |
| 8,132,288 | B2 | 3/2012 | Dawson | |
| 8,387,207 | B2 | 3/2013 | Dimbylow | |
| 8,510,908 | B2 | 8/2013 | Maguire | |
| 8,572,801 | B2 | 11/2013 | Engström | |
| 2006/0179606 | A1 | 8/2006 | Worwag | |
| 2009/0265883 | A1* | 10/2009 | Reed, Jr. | A47L 9/1608 15/353 |

* cited by examiner

VACUUM CLEANER SUCTION NOZZLE WITH HEIGHT ADJUSTMENT AND BLEED VALVE

FIELD OF THE INVENTION

The present invention relates to vacuum cleaners and vacuum cleaner suction nozzles, and more particularly to such devices having a feature to compensate for excessive suction generated by interaction between a suction inlet and a surface being cleaned.

BACKGROUND

Referring to FIG. 1, a typical upright vacuum cleaner 100 includes a base 102 that is configured to move along a surface such as a floor, and an upper housing 104 that usually is pivotally mounted to the base 102 and provided with a grip 106 that is used to manipulate and maneuver the device. The downward-facing surface of the base 102 includes a main suction inlet that faces the floor, and through which dirt-laden air is drawn into the device by a motor-driven vacuum fan 108. The vacuum fan 108 may be located in the upper housing 104, as shown, or in the base 102. The main inlet and vacuum fan 108 are in fluid communication by one or more ducts and flexible hoses that collectively form a flow path through the vacuum cleaner 100, as well-known in the art. Ultimately, the air exits the flow path through an outlet to the ambient air. Any number of filtration devices, such as screens, pleated filters, foam filters, and cyclonic separators may be included in the flow path, either upstream or downstream of the vacuum fan 108. For example, the upright vacuum cleaner 100 may have a dirt separation device 110, such as a bag filter or cyclone chamber, located in the upper housing 104. The dirt separation device 110 may alternatively be located in the base 102. Examples of full-size and smaller "stick" upright vacuum cleaners having these and other features are provided in U.S. Pat. Nos. 6,829,804; 7,163,568; 7,228,592; 7,293,326; 7,662,200; 7,814,612; and 8,572,801, which are incorporated herein by reference.

A typical canister vacuum cleaner 200, such as the one shown in FIG. 2, has a canister body 202 that is connected to a cleaning head 204 by a flexible hose 206 and rigid pipe 208. The pipe 208 often has a grip 210 for manipulating the cleaning head 204. The lower surface of the cleaning head 204 has a suction inlet that is fluidly connected, through the pipe 208 and hose 206, to a vacuum fan (not shown) located inside the canister body 202. As with an upright vacuum cleaner, the canister vacuum cleaner 200 has a flow path in which one or more filtration devices 212 are located. The filtration device 212 usually is in the canister body 202. It is also known to add auxiliary filtration devices, such as a small cyclone separator, to the pipe 208 or cleaning head 204. Examples of canister vacuum cleaners include U.S. Pat. Nos. 3,745,965; 4,953,253; 6,168,641; 6,502,277 and 7,951,214, which are incorporated herein by reference. A variation on a canister vacuum cleaner is a central vacuum, which uses a fixed cleaning module in one room of a house, and remote cleaning head ports in various rooms in the house. An example of such a device is shown in U.S. Pat. No. 4,829,626, which is incorporated herein by reference.

In some instances, the main inlet may be adjustable to space it at different heights relative to the surface being cleaned. Various vacuum cleaners having inlet height adjustment devices have been produced in the prior art. In many cases, the height adjustment device includes a carriage to raise and lower the front portion of a vacuum nozzle to regulate the height of a brushroll located inside the nozzle housing relative to the surface being cleaned. Such devices often are user-actuated by a foot pedal that engages a camming mechanism, but it is also known to use electronically or hand-operated devices. Examples of such a devices are shown in U.S. Pat. Nos. 4,167,801; 4,437,205; 4,467,495; 5,134,750; 5,609,024; 6,081,963; 7,246,407; 7,266,861; 7,293,326; and 7,945,988, which are incorporated herein by reference.

When cleaning some surfaces, the suction generated by the vacuum cleaner can draw portions of the surface (e.g., fibers of a carpet) near or into the suction inlet opening, decreasing the circulation of airflow and increasing negative pressure inside the vacuum cleaner airflow passages. This increased negative pressure can pull the vacuum cleaner head and the surface being cleaned together, causing a phenomenon (sometimes called "suction lock") that prevents easy movement of the cleaning head across the surface being cleaned. This condition can also prevent proper airflow across the suction fan motor, resulting in motor overheating.

Air bypass (i.e., "bleed") openings are often included in vacuum cleaner air paths to release negative pressure in the suction path, and increase the circulation of airflow even when the main inlet is very close or contacting the surface being cleaned. Such bypass openings can be positioned in various locations of vacuum cleaners. For example, some vacuum cleaners include a simple hole located within the body of the vacuum cleaner near the suction fan inlet, while others use unsealed seams at locations such as the cover over a vacuum bag chamber to discreetly allow air to continue to flow through the suction fan even if the normal cleaning inlet is blocked. Other devices have bypass openings located in the upper or side surfaces of the base 102 or cleaning head 204. Still other devices include slots around the perimeter of the suction inlet to provide tunnels to allow airflow even if the suction inlet is pressed flat against a surface. It is also known to provide vacuum cleaners with bleed valves to release pressure within the vacuum cleaner. For example, in some cases, a bypass opening is covered by a valve that opens when the pressure differential between the suction path and the outside air is great enough to overcome a spring or other device that normally holds the valve closed (i.e., a "bleed valve" or "pressure relief valve"). Examples of such devices are shown, for example, in U.S. Pat. Nos. 2,904,816; 2,904,817; and 6,018,845, which are incorporated herein by reference. While some known bleed openings and bleed valves may be helpful to avoid or reduce suction lock, in many cases they are provided primarily for other reasons, such as to prevent motor overheating.

There exists a need for improved pressure relieving mechanisms in cleaning heads of vacuum cleaners to prevent or reduce suction lock and allow for easy movement of the cleaning heads across cleaning surfaces.

SUMMARY

In one exemplary aspect, there is provided a vacuum cleaner nozzle assembly having an inlet opening, a height adjustment mechanism configured to adjust a vertical position of the inlet opening relative to a surface to be cleaned, a suction passage fluidly connected to the inlet opening, a bypass opening fluidly connected to the suction passage, and a bleed valve. The bleed valve has a closed position in which the bleed valve blocks the bypass opening, and an open position in which the bleed valve does not block the bypass opening to allow a flow of air through the bypass opening and into the suction passage. The bleed valve is configured to move from the closed position to the open position in response to an adjustment of the height adjustment mechanism.

In various other exemplary aspects, the height adjustment mechanism may include a front support, such as two wheels, configured to rest on the surface to be cleaned and move between a first position in which the front support holds the inlet opening at a first distance from the surface to be cleaned, and a second position in which the front support holds the inlet opening at a second distance from the surface to be cleaned, the second distance being greater than the first distance. In such an aspect, the height adjustment mechanism may be configured to move the bleed valve to the closed position or allow the bleed valve to be in the closed position when the front support is in the first position, and to hold the bleed valve in the open position when the front support is in the second position.

In still other exemplary aspects, there is provided a vacuum cleaner having a vacuum fan, an inlet opening fluidly connected to the vacuum fan, a dirt separation device configured to receive and clean a flow of dirt-laden air from the inlet opening, a height adjustment mechanism configured to adjust a vertical position of the inlet opening relative to a surface to be cleaned, a suction passage fluidly connected to the inlet opening, a bypass opening fluidly connected to the suction passage, and a bleed valve having a closed position in which the bleed valve blocks the bypass opening, and an open position in which the bleed valve does not block the bypass opening to allow a flow of air through the bypass opening and into the suction passage. The bleed valve is configured to move from the closed position to the open position in response to an adjustment of the height adjustment mechanism.

Aspects of the invention may be incorporated into, or used with, any kind of vacuum cleaner. Exemplary aspects are used with upright vacuum cleaners, canister vacuum cleaners, central vacuum cleaners, stick vacuum cleaners, and so on.

It will be appreciated that this Summary is not intended to limit the claimed invention in any way.

BRIEF DESCRIPTION OF THE DRAWINGS

A better understanding of the exemplary embodiments may be understood by reference to the attached drawings, in which like reference numbers designate like parts. The drawings are exemplary, and not intended to limit the claims in any way.

BRIEF DESCRIPTION OF EMBODIMENTS

Figure 1:
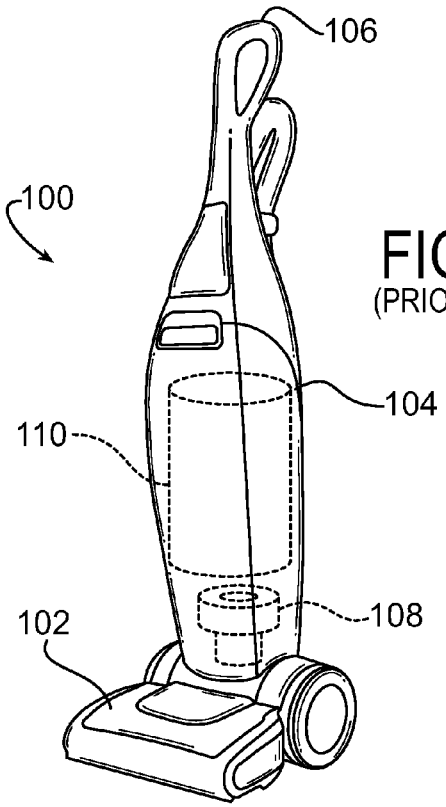
FIG. 1 (PRIOR ART)
FIG. 1 is an exemplary prior art upright vacuum cleaner that may be used in conjunction with embodiments of the present invention.
Figure 2:
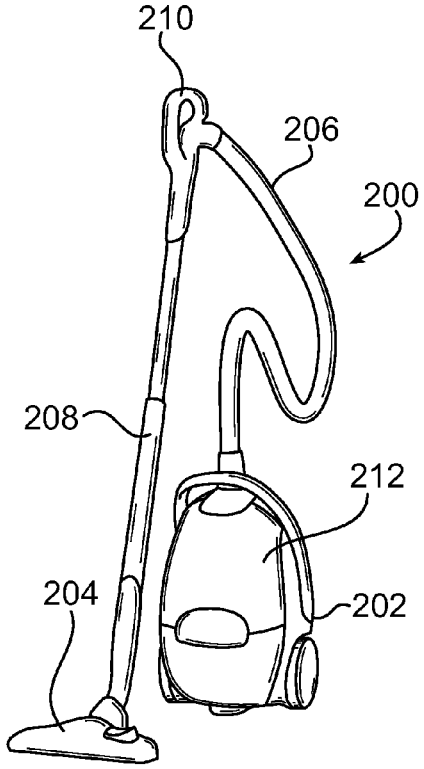
FIG. 2 (PRIOR ART)
FIG. 2 is an exemplary prior art canister vacuum cleaner that may be used in conjunction with embodiments of the present invention.

The exemplary embodiments described herein relate to, and are useable with, vacuum cleaners of all kinds. Examples of prior art vacuum cleaners are shown in FIGS. 1 and 2, which show an upright vacuum cleaner 100 and a canister vacuum cleaner 200, respectively. Other embodiments may be used with central, backpack, stick and other kinds of vacuum cleaner, such as those described previously herein or otherwise known in the art.

Suction lock is a phenomenon by which a surface being cleaned obstructs or completely blocks an inlet opening of a vacuum cleaner suction nozzle. This decreases air flow to the inlet opening and generates high negative pressure inside the vacuum cleaner. This negative pressure pulls the suction nozzle and the surface together, and can prevent easy movement of the cleaning head across the surface. In the past, the problem of suction lock has been addressed, in some cases, by using bypass air passages (that are either always open, or biased closed and opened in response to a pressure differential between the outside air and the internal suction passage) to allow air to enter the suction air path when the inlet opening is significantly obstructed by the surface. In other cases, vacuum cleaners have used a height adjustment mechanism to lift the suction inlet opening to prevent the inlet opening from coming into close contact with the underlying surface.

It has been discovered that existing vacuum cleaner designs for alleviating suction lock can be ineffective on certain carpet products that have recently gained widespread use (e.g., "soft" carpets available from Mohawk Industries, Inc. of Calhoun, Ga., USA). Such carpet products are believed to be newly-developed, but these or similar products may have been in uncommon use in the past. For example, an existing height adjustment mechanism that is effective at mitigating suction lock on older carpet designs of a certain pile height, has been found to be less effective at mitigating suction lock on a newer carpet design having a similar pile height. Without being bound to any theory of operation, it is believed that these new carpet products comprise fibrous materials that are either very soft, or particularly densely-packed (either to start with, or when subjected to the suction and/or physical pressure applied by the suction nozzle), thus reducing the amount of air that flows through the carpet fibers. This is believed to significantly reduce the flow of air to the inlet opening, and increase the suction lock phenomenon as compared to more conventional carpets of the same or similar nominal pile height. It has been further discovered that simply raising the inlet opening further from the carpet fibers is not an effective solution to this problem, because doing so significantly reduces cleaning effectiveness. It is also expected that existing vacuum cleaners that do not experience suction lock on such carpet surfaces may have relatively low suction ratings that may not be effective at cleaning either the carpets in question, or other kinds of floor surface.

The present invention is intended to address the problem of suction lock described immediately above. However, one of ordinary skill in the art will recognize many advantageous uses for the invention from the description herein, and the claimed invention is not intended to be bound to any particular use or theory of operation, and the inventions are not required to satisfy any particular performance or efficacy requirements.

Figure 3A:
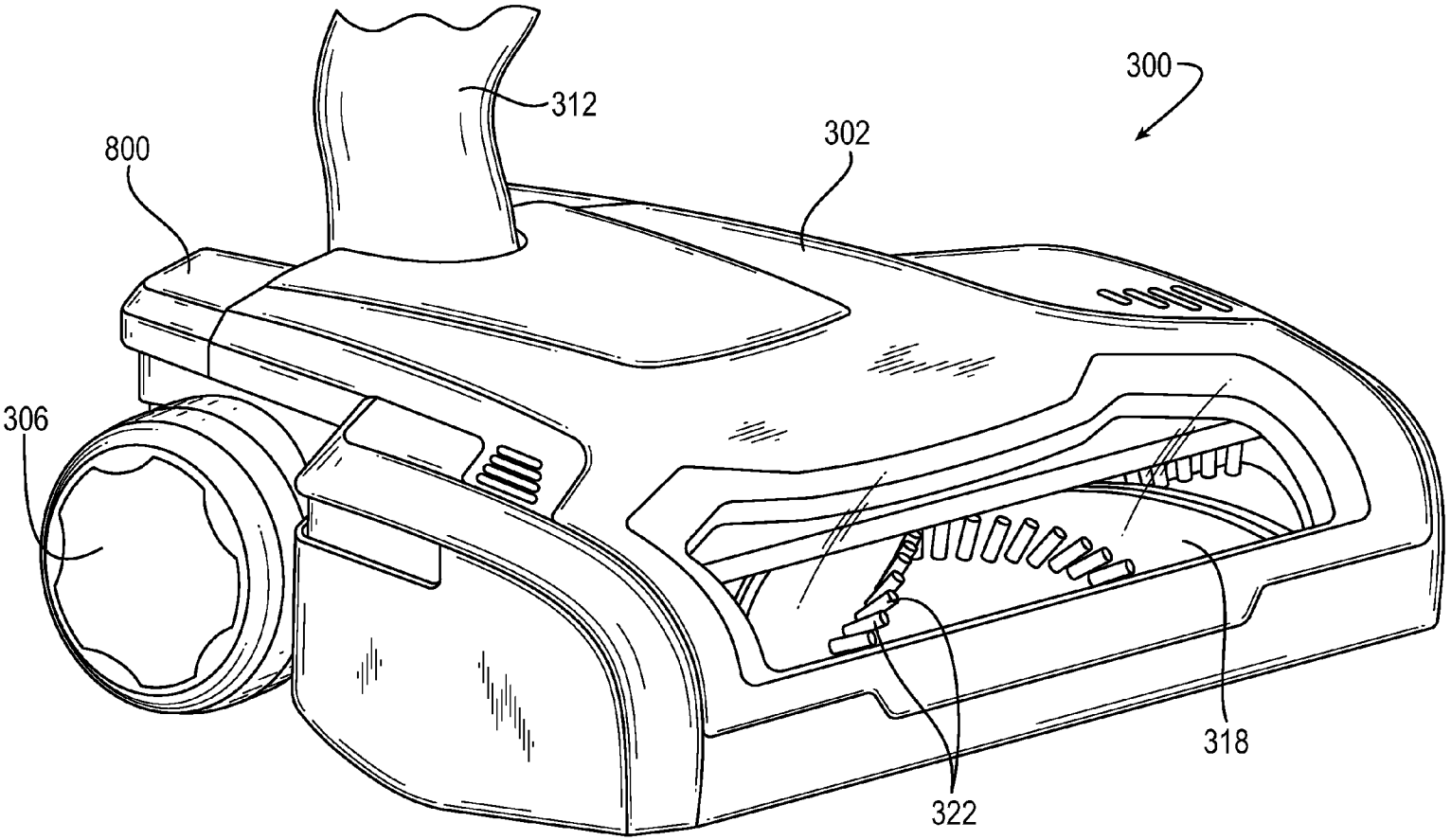
FIG. 3A is an isometric view of an exemplary nozzle assembly.
Figure 3B:
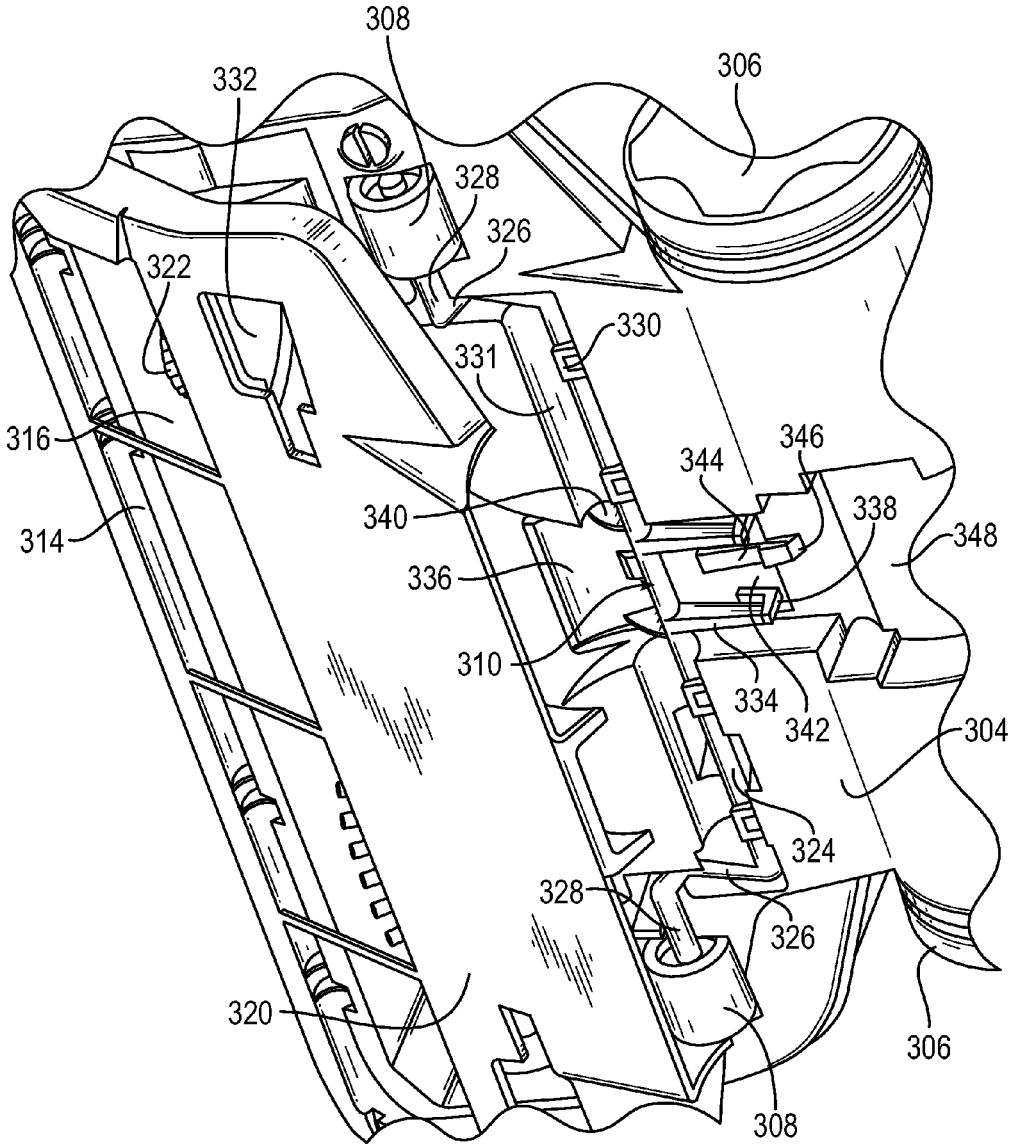
FIG. 3B is a bottom view of the nozzle assembly of FIG. 3A, shown with a base plate partially removed.

Referring to FIGS. 3A and 3B, an exemplary vacuum nozzle generally includes a nozzle housing 300 having a top cover 302 (FIG. 3A) that is attached to a base frame 304 (FIG. 3B). The nozzle housing 300 is supported for movement over a surface being cleaned at the rear by a rear support, such as rear wheels 306, and at the front by a front support, such as one or more front wheels 308. The front wheels 308 (or other support devices, such as one or more skids, balls, casters, or a plate) are attached to a carriage 310 that is adapted to move the front wheels 308 vertically with respect to the nozzle housing 300. This movement adjusts the height of an inlet opening 314, which is located on the bottom of the nozzle housing 300, relative to the surface to be cleaned.

The nozzle housing 300 may be attached to any suitable cleaning device. In the exemplary embodiments shown herein, the cleaning device comprises a conventional powerhead attachment for a canister, central, or backpack vacuum. A hollow vacuum wand, handle or hose (see, e.g., FIG. 2) can be attached to the nozzle housing 300 by a stem 312 that connects the inlet opening 314 to a vacuum source, and connects a brushroll motor and other electronics by electrical contacts (not shown) to an electrical source, as known in the art. The stem 312 may be pivotally mounted to the nozzle housing 300 and provided with a latch (not shown) that may be used to lock the stem 312 in the upright (or other) position. The associated vacuum cleaner can use a bag, cyclone, or any other kind of dirt collection system. Alternatively, the nozzle housing 300 may be the base of an upright or stick vacuum cleaner (see, e.g., FIG. 1), and the stem 312 may be modified to connect to or be part of the vacuum cleaner upper housing. The connections between the nozzle housing 300 and other features (e.g., electronics and suction paths) of cleaning devices are understood by those of ordinary skill in the art, and need not be described further herein. Any variations of such connections may be used with the present invention.

The nozzle housing 300 includes the downward facing inlet opening 314, which may be shaped in the form of a brushroll chamber 316. In the shown embodiment, the brushroll chamber 316 is formed as part of the base frame 304, but it instead may be formed by the top cover 302 or by other parts. A brushroll 318 or other agitator or agitators may be provided in the brushroll chamber 316. The exemplary brushroll 318 is mounted to the nozzle housing 300 by a removable or plastic base plate 320 that captures in the brushroll 318 in place, as known in the art, but other agitator attachment configurations may be used. The base plate 320 is shown partially-removed in FIG. 3B. The brushroll 318 may comprise any type or combination of agitating members 322, such as helical rows of bristles and/or flaps, as known in the art. The agitating members 322 extend through the inlet opening 314 to contact the surface being cleaned. The brushroll 318 may be rotated by any type of motor, such as an air turbine, an electric motor that also drives a vacuum fan, wheels that contact the surface being cleaned, or a separate brushroll motor, as known in the art. The brushroll 318 may be omitted in other embodiments.

As noted above, the carriage 310 is used to adjust the height of the front wheels 308 relative to the nozzle housing 300, which has the result of moving the inlet opening 314 (and the brushroll 318) vertically with respect to the surface being cleaned. Such adjustments may be desirable to regulate airflow into the inlet opening 314, and to control how deeply the brushroll 318 penetrates carpet surfaces. Such height adjustments also may enable the brushroll 318 to be lifted out of contact with surfaces that may not benefit from using a brushroll, such as hardwood, linoleum or tiled floors. Where no brushroll is used, such height adjustments still may be provided to regulate the inflow of air into the inlet opening 314.

The carriage 310 of the exemplary embodiment comprises a generally U-shaped structure having a laterally extending crosspiece 324 and a leg 326 at each end of the crosspiece 324. The legs 326 are bent to form wheel mounts 328. The front wheels 308 may be rotatably attached to the wheel mounts 328 and held in place by a snap, pushnut, or other fastener, as known in the art. The crosspiece 324 may be mounted by any suitable method, such as by being retained by tabs 330 in a channel 331 formed in the base frame 304, or by being captured in place by the base plate 320. Bearings, bushings, or simple contoured mounts may be used to hold the crosspiece 324, if desired. The crosspiece 324 and the rest of the carriage 310 is rotatable about the longitudinal axis of the crosspiece 324, and the wheel mounts are located at a free end of the carriage 310 that is spaced from the longitudinal axis. Thus, rotation of the crosspiece 324 results in vertical movement of the front wheels 308. The wheels 308 and portions of the legs 326 may extend through slots 332 in the base plate 320 to provide them with an unobstructed travel path.

As explained in more detail below, the height adjustment mechanism also includes a height adjustment control mechanism that is used to pivot the carriage 310, and thereby move the front wheels 308 relative to the nozzle housing 300. Non-limiting examples of such height adjustment control mechanisms are shown in various patents referenced above in the Background, as well as in U.S. Pat. No. 8,214,966, which is incorporated herein by reference. The height adjusting mechanism may operate by rotating, linear, sliding or other movements, if desired. Furthermore, the carriage 310 may be replaced by any other mechanism that moves the wheels 308, such as a plunger-type device that moves in a linear direction. Such modifications will be understood by persons of ordinary skill in the art in view of the present disclosure.

In the shown embodiment, a height adjustment control mechanism rotates the carriage 310 about the crosspiece 324, to thereby rotate the legs 326, to move the wheels 308 to the desired position relative to the inlet opening 314. The height adjustment control mechanism may act directly on the crosspiece 324, or it may press on one of the legs 326, or it may press on an extension that protrudes from the crosspiece 324. Other configurations may be used in other embodiments.

The nozzle housing 300 also includes one or more bleed valves 336. The bleed valve is provided to allow air to enter the suction path inside the nozzle housing 300 through a bypass opening that is located downstream of the inlet opening 314, to thereby reduce any excess suction that might be generated if the inlet opening 314 is completely or excessively blocked by the surface to be cleaned. Thus, when the bleed valve 336 is open, suction lock can be avoided, or the effects of suction lock can be reduced. The bleed valve 336 preferably is operated in conjunction with the height adjustment mechanism, so that the bleed valve 336 is opened when the height adjustment mechanism is at its higher or highest settings, but closed when the height adjustment mechanism is at its lower or lowest settings. In this way, the bleed valve 336 remains closed to apply maximum suction to the inlet opening 314 during use on hard floors and low carpets, but opens when the nozzle housing 300 is adjusted for use on high-pile or softer carpets where suction lock is more likely to be a problem. Examples of mechanisms to open the bleed valve 336 when the suction nozzle 300 is adjusted to higher settings are described below, but other mechanisms may be used in other embodiments.

The exemplary bleed valve 336 of FIG. 3B comprises a door-like panel that is movably mounted to the nozzle housing 300, below the nozzle's suction passage 500 (see FIG. 5A). The bleed valve 336 is mounted in or adjacent to an air bypass opening 502 (FIG. 5A) that passes from the suction passage 500 to the outside air. The upper surface of the bleed valve 336 may form part of the suction passage 500 when the bleed valve 336 is closed. The lower surface of the bleed valve 336 may face the floor, or it may be covered by an enclosure to prevent air from traveling straight up through the bleed valve. In the shown embodiment, the bottom of the bleed valve 336 is covered by a portion of the base plate 320 that forms a bleed valve chamber 506 (see, e.g., FIG. 5A) below the bleed valve 336.

Figure 4A:
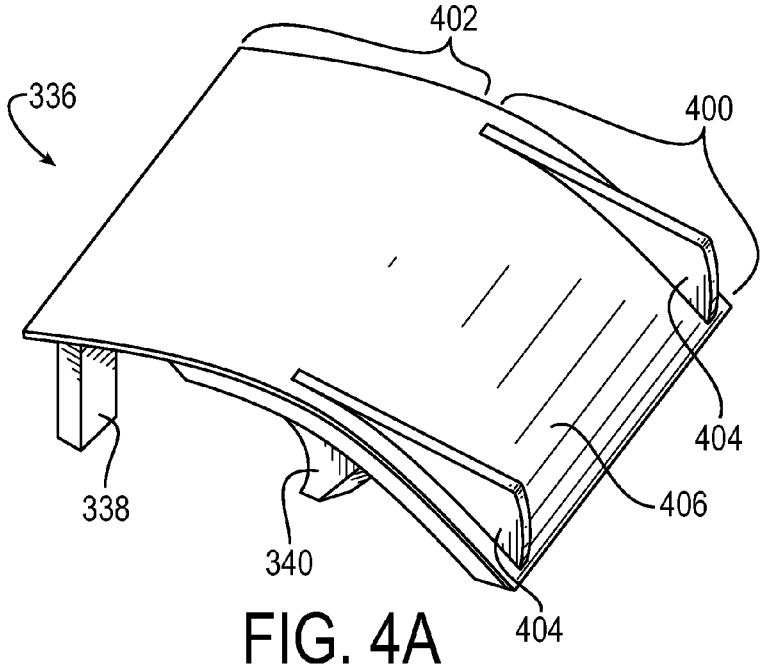
FIG. 4A is an isometric top view of an exemplary bleed valve that may be used in the embodiment of FIG. 2.
Figure 4B:
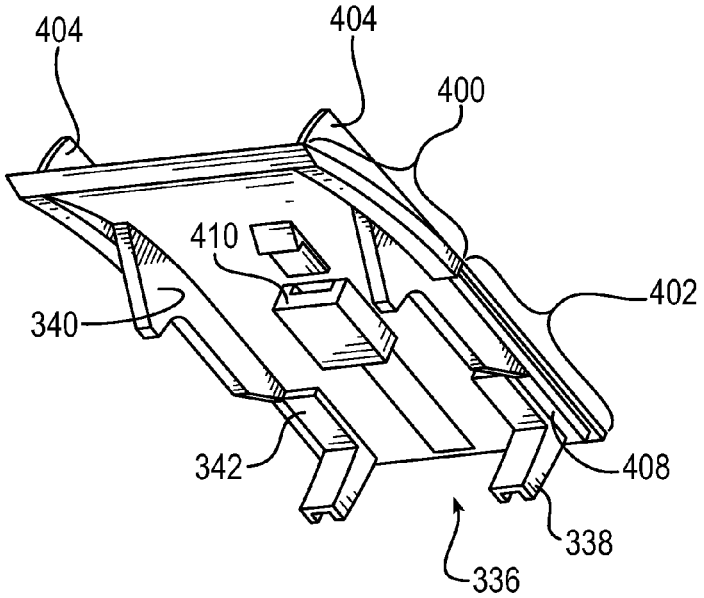
FIG. 4B is an isometric bottom view of the bleed valve of FIG. 4A.

Referring to FIGS. 4A and 4B, the exemplary bleed valve 336 generally includes an arced front section 400 and a relatively flat rear section 402. Alternatively, the bleed valve 336 may be entirely flat or entirely curved. Various suitable geometries for the bleed valve 336 will be understood by one of skill in the art from the description herein. As shown in FIG. 4B, the outer perimeter 408 of the flat section 402 may be comprise a beveled shelf, and projections 404 may be formed on the top surface 406 of the arced section 400. The functions of the projections 404 and beveled perimeter 408 will be described with respect to FIGS. 5A and 5B.

The bleed valve 336 may be connected to the nozzle housing 300 in any suitable manner to allow selective opening and closing of the bleed valve 336. In the shown embodiment, curved protrusions 340 extend from the lower surface of the bleed valve 336, and these protrusions wrap partially around the round cross-section of the crosspiece 324, as shown in FIGS. 5A and 5B. Interaction between these parts provides a pivoting connection between the bleed valve 336 and the nozzle housing 300. Alternatively, the bleed valve 336 may be coupled to the nozzle housing 300 by a hinge, sliding parts, or other suitable mechanisms, as will be understood by those of ordinary skill in the art from the description herein.

The bleed valve 336 also may include a resilient member to bias the bleed valve 336 into the closed position. For example, the bleed valve 336 includes a resilient member 344 in the form of a leaf spring (made of steel or other resilient material) that couples bleed valve 336 to the base frame 304. A slot 410 in the bleed valve 336 is configured to receive one end of the resilient member 344, and a recess 346 in the base frame 304 is configured to receive the other end of the resilient member 344. In this embodiment, the resilient member 344 is captured in place on the bleed valve 336, and is free to slide within the recess 346 on the base frame 304 to allow the bleed valve 336 to open and close, but the opposite or other arrangements may be used.

The height adjustment mechanism preferably includes one or more features to interact with and selectively open the bleed valve 336. For example, the exemplary carriage 310 includes lever arms 334 that extend from the crosspiece 324 and adjacent to the bleed valve 336, to selectively open the bleed valve 336 when the height adjustment control mechanism rotates the crosspiece 324 to the maximum height setting. In this embodiment, the lever arms 334 are positioned below the bleed valve 336 and extend rearward towards protrusions 338 that extend from the bottom of the bleed valve 336. The protrusions 338 are provided to contact the ends of the lever arms 334 to prevent the bleed valve 336 from sliding forward, but these are not necessary in all embodiments.

When the height of the nozzle housing 300 is adjusted vertically upward (i.e., to move the wheels 308 away from the inlet opening 314), the crosspiece 324 rotates, causing the lever arms 334 to incrementally rotate upward toward the bottom surface 342 of the bleed valve 336. When the height of the nozzle housing 300 is adjusted to the highest vertical position, the lever arms 334 contact and push the bottom surface 342 of the bleed valve 336 upward, causing the bleed valve 336 to open. The mechanism by which this occurs will now be described in more detail with reference to FIGS. 5A and 5B.

Figure 5A:
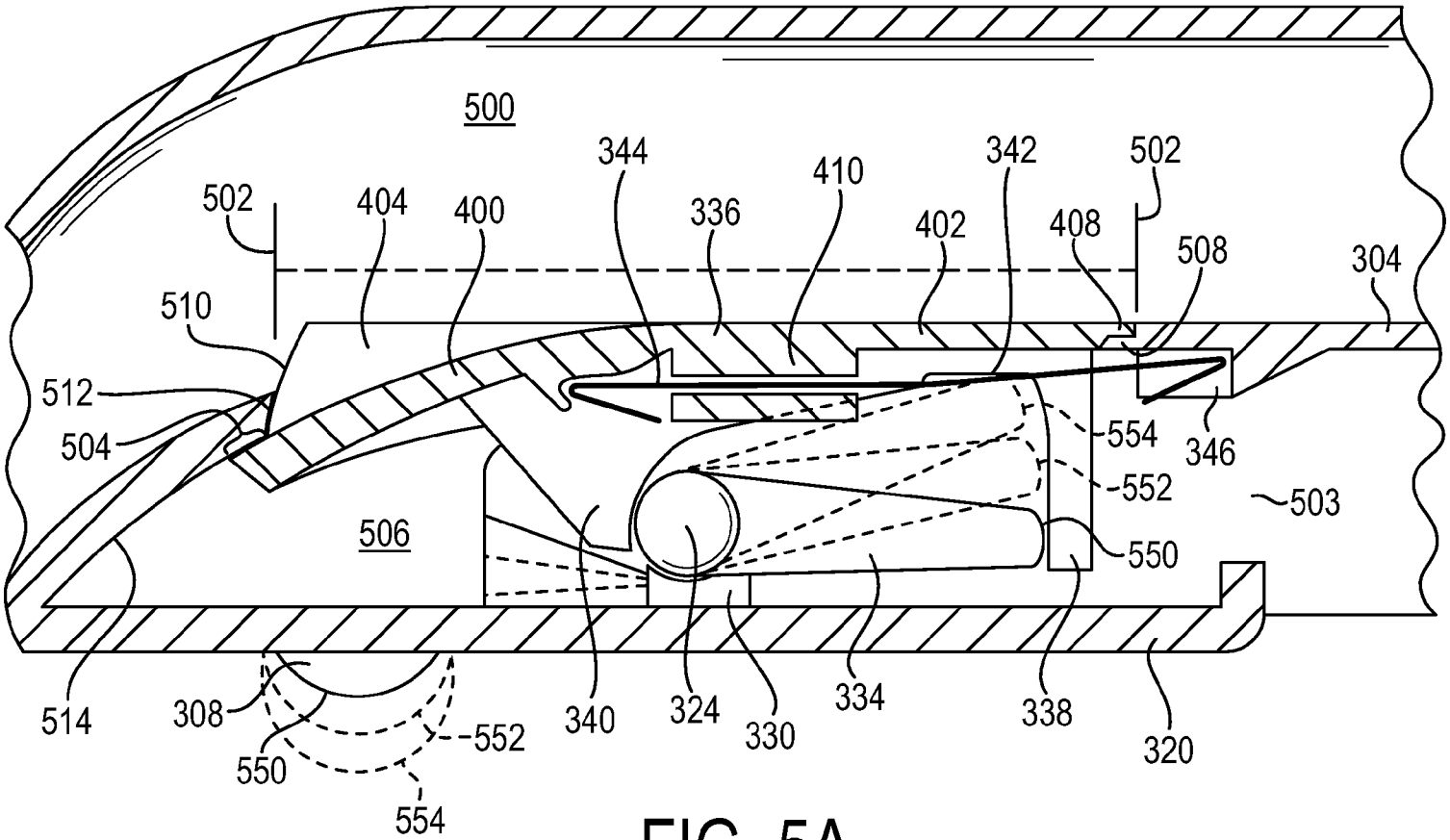
FIGS. 5A and 5B are cross-sectional side views of the nozzle assembly of FIG. 3, showing a bleed valve in various positions.
Figure 5B:
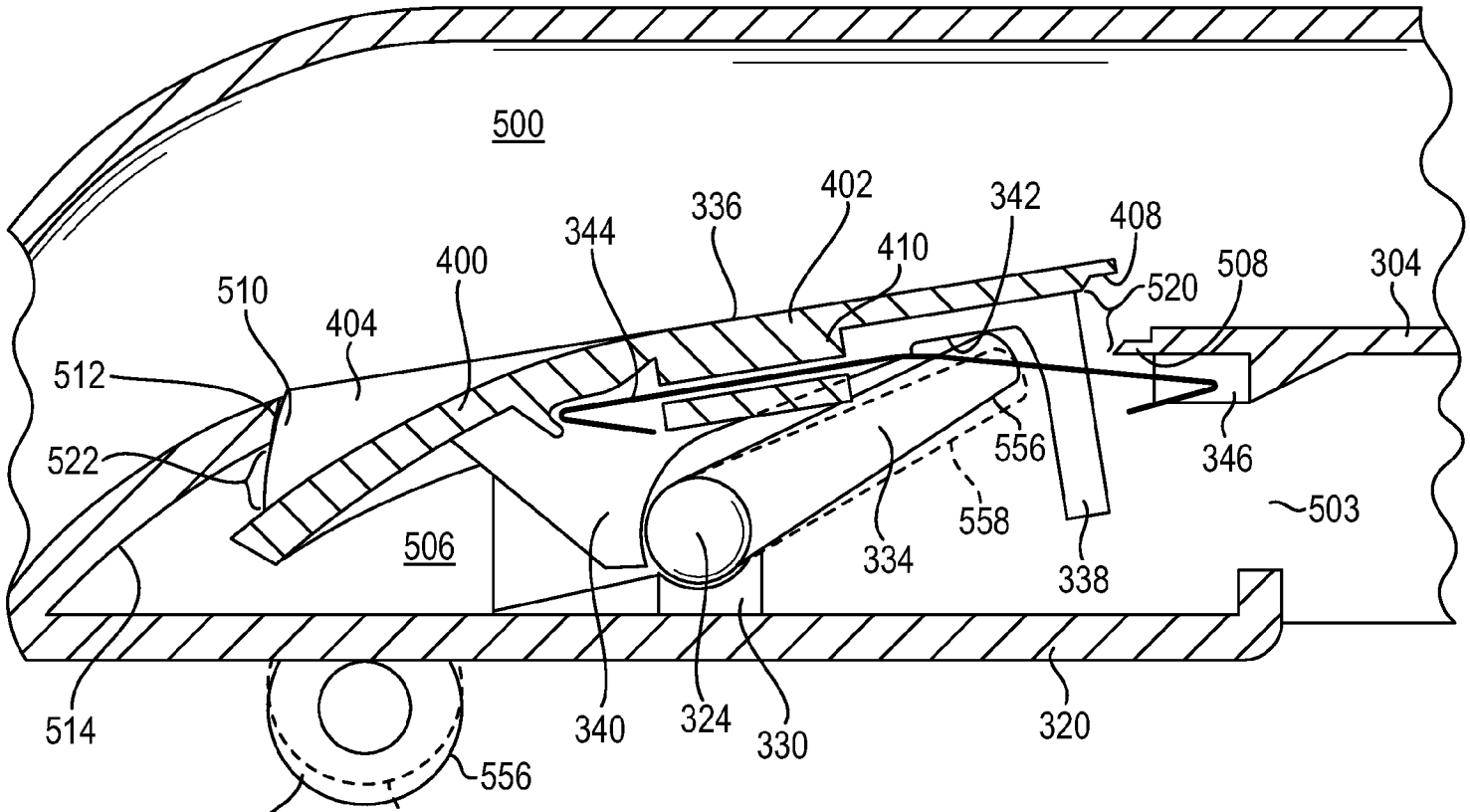

FIGS. 5A and 5B show the bleed valve 336 located in an exemplary bleed chamber 506. The bleed chamber 506 is positioned below an internal suction passage 500 that joins the inlet opening 314 to a suction source (e.g., a suction fan or a suction line leading to a suction fan). The bleed chamber 506 has a bleed chamber inlet opening 503 that faces backwards, or is otherwise angled relative to the plane of the underlying surface to be cleaned, so that it cannot be blocked by the surface. As shown in FIG. 3B, the opening 503 may adjoin a channel 348, formed in the base frame 304, that leads to the back of the nozzle housing 300.

The bleed valve 336 is configured to generally block the air bypass opening 502 when the bleed valve 336 is in the closed position (a perfect seal is not required, and some leakage is expected and would be acceptable provided it does not degrade the cleaning performance below desired levels), and to allow airflow into the suction passage 500 when the bleed valve 336 is in the opened position. FIG. 5A shows the bleed valve 336 in the closed position, and FIG. 5B shows the bleed valve 336 in the open position. In this embodiment, the upper surface of the bleed valve 336 is generally flush with the interior wall of the suction passage 500 when the bleed valve 336 is closed, to reduce air turbulence and minimize the effect of the bleed valve 336 on air and dirt flowing from the inlet opening 314 to the dirt receptacle of the vacuum cleaner. Also in this embodiment, when the bleed valve 336 is open, the front of the bleed valve moves externally to the suction passage 500, while the rear of the bleed valve moved into the suction passage 500. This is not required in all embodiments, and other bleed valves may open entirely outside the suction passage 500, or entirely inside the suction passage 500.

The bleed valve 336 includes a front sealing portion 504 (FIG. 5A) on the arced front section 400 that extends from a front surface 510 of the projections 404 to the leading edge of the arced section 400. In the closed position, the top surface of the front sealing portion 504 contacts a correspondingly-shaped portion of an interior surface 514 of the bleed chamber 506, to provide a seal at this juncture. Similarly, the beveled outer perimeter 408 of the flat section 402 at the rear of the bleed valve 336 contacts a corresponding recessed area 508 around the rear edge of the opening 502, to provide a seal at this juncture. This matching geometry advantageously prevents lateral movement of the bleed valve 336 and helps prevent the flow of air from the bleed chamber 506 to the suction passage 500 when the bleed valve 336 is in the closed position. If desired, additional seals, such as rubber gaskets or the like, may be included on the bleed valve 336 or the base frame 304 to help prevent air leakage when the parts are in the closed position.

As noted above, projections 404 may extend upwards from the upper surface of the bleed valve 336. The projections 404 may comprise front surfaces 510 that abut a corresponding surface 512 at the front edge of the opening 502 to prevent forward movement of the bleed valve 336 while the nozzle housing 300 is in operation. Such movement also may be resisted by the protrusions 338 contacting the ends of the lever arms 334, as noted above. The projections 404 also may be sized to abut lateral edges of the opening 502 to prevent lateral movement, and may be configured to inhibit air from flowing sideways into the opening 502 when the bleed valve 336 is open. This latter function may be helpful to maintain the smooth flow of air through the suction passage 500.

As described above, the crosspiece 324 of the carriage 310 rests in a channel and is held in the base frame 304 by tabs 330. In this position, the lever arms 334 are positioned adjacent the bleed valve 336, and nested between the curved protrusions 340 and the rear protrusions 338. The lever arm 334 may freely rotate through a limited arc of travel, within the bleed chamber 506. In FIG. 5A, the lever arms 334 and the front wheels 308 are depicted in solid lines, as they would be in the lowest vertical position 550 of the nozzle housing's 300 height adjustment mechanism. The height adjustment mechanism may have multiple intermediate height adjustment positions in which the bleed valve 336 remains in the closed position. The positions of the wheels 308 and lever arm 334 are shown in these intermediate positions by broken lines marked by reference numbers 552 and 554. When the height of the nozzle housing 300 is adjusted from the lowest position 550 to the an intermediate position 553, 554, the crosspiece 324 rotates, causing the front wheels 308 to extend downward and the lever arms 334 to rotate incrementally toward the bottom surface 342 of the bleed valve 336. The incremental rotation of the lever arms 334 toward the bottom surface 342 may be repeated at each increasing height adjustment, as desired. Three height adjustment positions in which the bleed valve 336 remains in the closed position are shown in FIG. 5A, but it is contemplated that more or fewer height adjustment positions where the bleed valve 336 remains closed may be used in other embodiments.

Turning to FIG. 5B, when the nozzle housing 300 is adjusted to the highest position, the front wheels 308 extend fully downward and the lever arms 334 rotate to their highest position 556 with respect to the bleed valve 336. In this position, the lever arms 334 contact the bottom surface 342 of the bleed valve 336, and rotate the bleed valve 336 about the crosspiece 324 (or other pivot). This movement raises the rear section 402 of the bleed valve 336 out of the recessed area 508 of the opening 502, and lowers the front section 400 of the bleed valve 336 downward into the bleed chamber 506.

Raising the rear section 402 of the bleed valve 336 causes the resilient member 344 to contact the base frame 304 and flex. This flexing movement exerts a downward restoring force that biases the bleed valve 336 back towards the closed position. However, the lever arms 334 remain fixed against the bottom surface 342 of the bleed valve 336, overcoming the downward biasing force, and thereby keeping the bleed valve 336 in the open position. The front surfaces 510 of the projections 404 advantageously remain substantially in contact with the arced surface 512 of the bleed chamber opening to prevent forward movement of the bleed valve 336 while the bleed valve 336 is in the open position.

In the open position, the bleed valve 336 permits air to flow from the bleed chamber 506 to the suction passage 500 via temporary openings 520 and 522 at the rear and front of the bleed valve 336, respectively. This allows airflow into the nozzle housing 300 to relieve pressure and prevent or mitigate suction lock when the wheels 308 are moved to the highest height adjustment setting. If desired, the parts also may be configured to open the bleed valve 336, at least partially, when the wheels 308 are not yet in the highest position. For example, the height adjustment control mechanism may be configured to hold the crosspiece 324 and lever arms 334 in an intermediate position (see dashed lines 558 in FIG. 5B) between the position shown in FIG. 5A and the position shown in FIG. 5B. It will also be appreciated that the height adjustment control mechanism may be able to hold the crosspiece 324 and lever arms 334 in any position between the positions shown or described herein.

Adjusting the nozzle housing 300 from a higher position to a lower position causes the lever arms 334 to rotate downward away from the bottom surface 342 of the bleed valve 336. When this happens, the downward biasing force from the resilient member 344 rotates the bleed valve 336 towards to the closed position, and eventually pulls the beveled perimeter 408 into the recessed area 508, and the front portion 504 into contact with the interior surface 514 of the bleed chamber 506, thereby closing the bleed valve 336 and substantially stopping the airflow from the bleed chamber 506 into the nozzle housing 300.

The foregoing describes one exemplary embodiment of the invention. As will be appreciated by those of ordinary skill in the art in view of the present disclosure, this embodiment may be modified in a number of ways. For example, the bleed valve may be located in other portions of the nozzle housing (e.g., on the side, on the top cover, etc.), or on a stem 312, upper housing 104, or other location on the vacuum cleaner. The bleed valve also may be adjacent the inlet opening, to selectively expand the size of the inlet opening when the bleed valve is opened. In addition, it is contemplated that the bleed valve may be held in the closed position by suction within the nozzle housing, such that a resilient member need not be used, of the bleed valve may be biased open by a spring, and forced into the closed position when the nozzle housing is moved to the lower positions. As another example, the mechanism that opens the bleed valve may be modified or moved (e.g., located inside the suction passage 500). Other embodiments also may adjust the height of the rear support, instead of the front support. Other variations and embodiments will be readily apparent to persons of ordinary skill in the art in view of the present disclosure.

Figure 6:
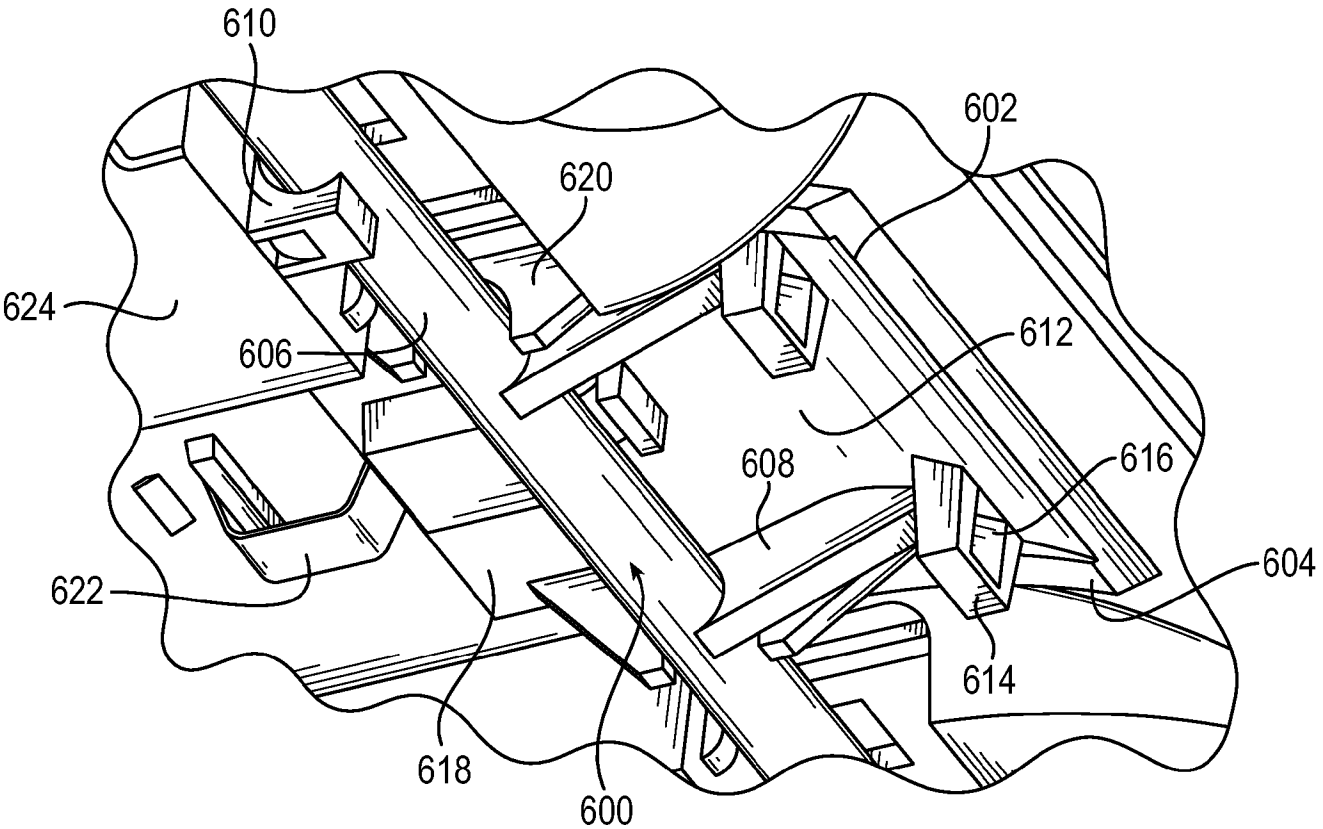
FIG. 6 is a bottom view of portions of an exemplary carriage and a bleed valve.
Figure 7A:
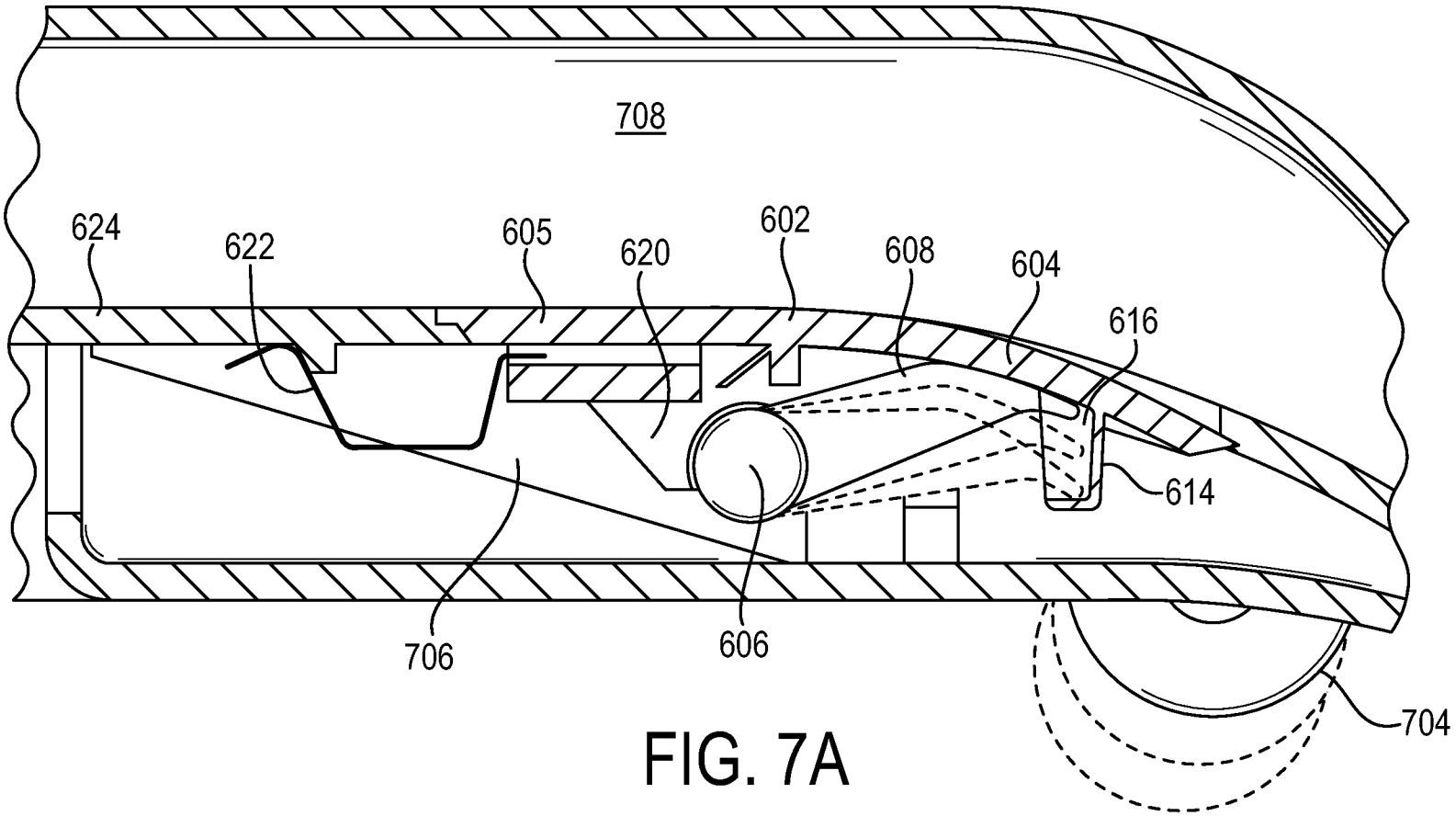
FIGS. 7A and 7B are cross-sectional side views of the assembly of FIG. 6, showing the bleed valve in various positions.
Figure 7B:
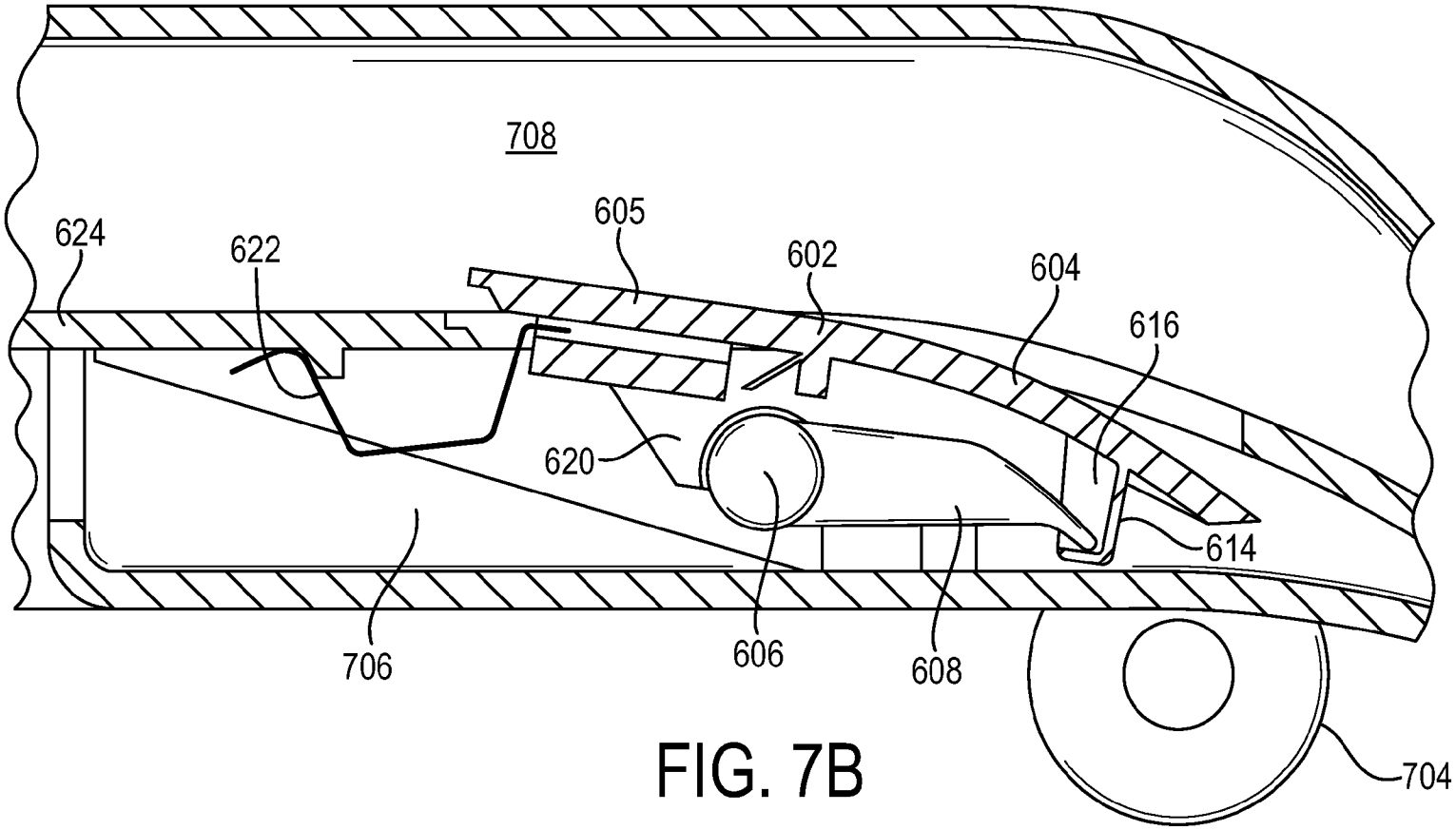

In one example of an alternative embodiment, depicted in FIGS. 6-7B, a carriage 600 may be configured to open a bleed valve 602 by pulling down on the bleed valve 602. The exemplary carriage 600 has a crosspiece 606 with lever arms 608 extending therefrom, and is rotatably mounted in a channel and held by tabs 610, similar to tabs 330. The bleed valve 602 includes a front section 604, and a rear section 605, and may additionally include projections (not depicted) similar to projections 404. Formed on a bottom surface 612 of the front section 604 are protrusions 614 that include slots 616 configured to receive the lever arms 608. The bottom surface 618 of the rear section 605 also may have curved protrusions 620 that are shaped to fit over the crosspiece 600 to act as a pivot joint between the bleed valve 602 and the crosspiece 606. A resilient member 622 (e.g., a steel leaf spring) couples the bleed valve 602 to a base frame 624 of the nozzle assembly.

Referring to FIGS. 7A and 7B, the bleed valve 602 may be located in a bleed chamber 706. FIG. 7A shows the bleed valve 602 in a closed position, and FIG. 7B shows the bleed valve 602 in an open position. The bleed valve 602 functions substantially as bleed valve 336 described above. However, in this embodiment, adjusting the height of the nozzle assembly upward causes the crosspiece 606 and lever arms 608 to rotate downward within the slots 616 in the protrusions 614. When the nozzle assembly is adjusted to the highest position, the lever arms 608 rotate downward to contact the bottoms of the slots 616, and pull the front section 604 of the bleed valve 602 downward into the bleed chamber 706. This causes the rear section 605 of the bleed valve 602 to rise up into an adjacent suction passage 708 located inside the nozzle assembly. In the open position, the bleed valve 602 allows ambient air to ender the suction passage 708 to prevent or mitigate suction lock. Adjusting the nozzle assembly to a lower height causes the lever arms 608 to rotate upward within the slots 616, and a biasing force from the resilient member 622 moves the bleed valve 602 to the closed position. In this embodiment, the lever arm 608 also may be configured to press against the bottom of the bleed valve 602 to hold it closed when the height of the nozzle assembly is adjusted to its lowest setting, as shown in FIG. 7A.

Figure 8:
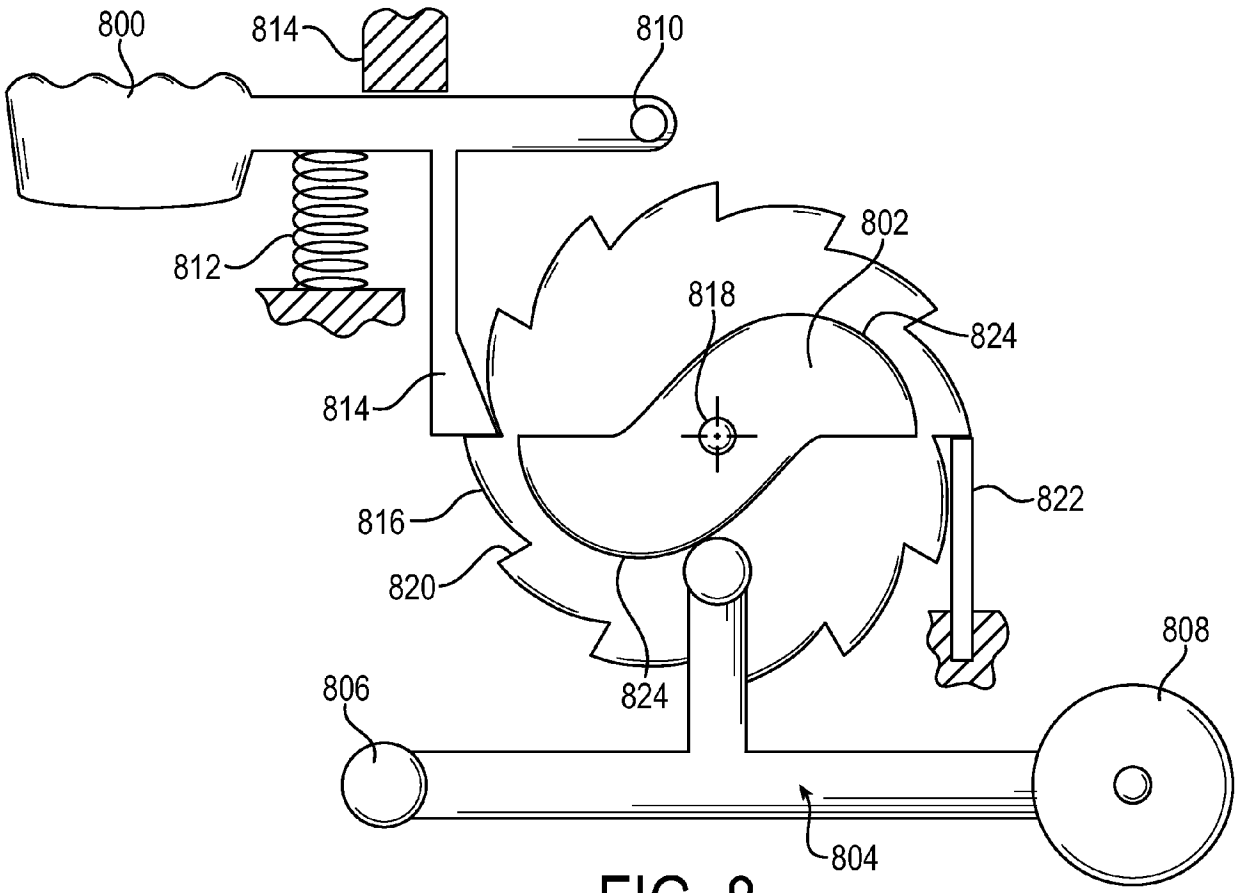
FIG. 8 is a schematic view of an exemplary height adjustment mechanism that may be used in conjunction with embodiments of the present invention.

Referring now to FIG. 8, an exemplary embodiment of a height adjustment mechanism is described. The height adjustment mechanism generally includes a pedal 800 that is located for access by the user (see, e.g., FIG. 3), and adjustment cam 802, and a carriage 804. The carriage 804 is mounted to the nozzle housing by pivot 806, and includes a support, such as a wheel 808, located distally from the pivot 806. The carriage 804 may be constructed like the carriages described previously herein, or have other constructions.

The pedal 800 is mounted to the nozzle assembly by pivot 810, and is biased to a return position (shown in FIG. 8) by a spring 812. A travel stop 814 prevents the pedal 800 from moving past the return position. The pedal 800 also includes a cam driver 814 that extends from the pedal to engage a drive wheel 816 associated with the adjustment cam 802. The drive wheel 816 is a generally round wheel that is rotatably mounted to the nozzle housing on a rotation axis 818. The drive wheel has a series of ledges 820 arranged around its outer perimeter and extending generally radially from the rotation axis 818. The cam driver 814 is positioned to abut an adjacent one of the ledges 820 when the pedal 800 is in the return position. When the pedal is depressed against the bias of the spring 812, the cam driver 814 pushes down on the adjacent ledge 820 to advance the drive wheel 816 to place the next ledge 820 adjacent the cam driver 814 when the cam driver 814 returns to the return position. A retainer spring 822 is provided to hold another one of the ledges 820 so that the drive wheel 816 does not rotate backwards as the pedal 800 is returning to the return position. The retainer spring 822 may comprise a simple cantilevered beam that flexes as each ledge 820 passes by it, and returns to a straight position to hold the ledge 820. Once the retainer spring 822 is holding the ledge 820, the pedal is released and the cam driver 814 can flex away from the adjacent ledge 820 as it moves upwards to return to the position shown in FIG. 8.

The adjustment cam 802 is drivingly connected to rotate with the drive wheel 816. The adjustment cam 802 comprises one or more cam-shaped ramps 824 that abut the carriage 804 and hold the carriage 804 against vertical movement. The shown example has two ramps 824. Each ramp 824 transitions from a first location that is relatively close to the rotating axis 818, to a second location that is relatively far from the rotating axis 818. As the drive wheel 816 is rotated, different parts of the ramps 824 contact the carriage 804 to hold it at progressively greater distances from the rotating axis 818. The number of ledges 820 will dictate the number of incremental height adjustment steps. In this case, there are six ledges 821 per ramp 824, providing six different height adjustment settings. If desired, the ramps 824 may include detents to help prevent reverse rotation or more firmly engage with the carriage 804.

In the shown embodiment, the ramps 824 engage a post 826 that extends upwards from the carriage 806, but other arrangements may be used. For example, the ramps 824 may engage a part that is provided between the ramps 824 and the carriage 806.

The type and details of the height adjustment control mechanism may vary in other embodiments, and other modifications and embodiments will be apparent to persons of ordinary skill in the art in view of the present disclosure. For example, a height adjustment control mechanism may use an entirely different arrangement of parts to move the carriage, and it may be operated by an electric motor, by a hand-operated knob or lever, or the like. Other non-limiting examples of mechanisms are incorporated herein by reference in earlier discussions herein.

Having described various exemplary embodiments, it will be appreciated that the present invention offers the opportunity to reduce or eliminate the incidence of suction lock on carpets that heretofore have caused problems for conventional cleaning nozzle designs. Of course, embodiments can also be used with conventional carpets and other surfaces to be cleaned, and may provide enhanced cleaning even on conventional carpets and the like.

The embodiments described herein are all exemplary, and are not intended to limit the scope of the claimed inventions. It will be appreciated that the inventions described herein can be modified and adapted in various and equivalent ways, and all such modifications and adaptations are intended to be included in the scope of this disclosure and the appended claims.

We claim:

1. A nozzle assembly for use in a vacuum cleaner, the nozzle assembly comprising:

an inlet opening;

a height adjustment mechanism configured to adjust a vertical position of the inlet opening relative to a surface to be cleaned;

a suction passage fluidly connected to the inlet opening;

a bypass opening fluidly connected to the suction passage;

a bleed valve comprising a closed position in which the bleed valve blocks the bypass opening, and an open position in which the bleed valve does not block the bypass opening to allow a flow of air through the bypass opening and into the suction passage, the bleed valve being operatively connected to the height adjustment mechanism and configured to move from the closed position to the open position in response to an adjustment of the height adjustment mechanism; and a resilient member configured to bias the bleed valve to the closed position.

2. The nozzle assembly of claim 1, wherein the nozzle assembly further comprises a brushroll rotatably mounted in the inlet opening.

3. The nozzle assembly of claim 1, wherein:

the height adjustment mechanism comprises a front support configured to rest on the surface to be cleaned, the front support being movable between a first position in which the front support holds the inlet opening at a first distance from the surface to be cleaned, and a second position in which the front support holds the inlet opening at a second distance from the surface to be cleaned, the second distance being greater than the first distance; and wherein the height adjustment mechanism is configured to move the bleed valve to the closed position or allow the bleed valve to be in the closed position when the front support is in the first position, and to hold the bleed valve in the open position when the front support is in the second position.

4. The nozzle assembly of claim 3, wherein the front support is movable between one or more intermediate positions between the first position and the second position, at each of which intermediate positions the front support holds the inlet opening at a respective intermediate distance from the surface to be cleaned, each respective intermediate distance being between the first distance and the second distance.

5. The nozzle assembly of claim 4, wherein the height adjustment mechanism is configured to allow the bleed valve to be in the closed position when the front support is in one or more of the intermediate positions.

6. The nozzle assembly of claim 4, wherein the height adjustment mechanism is configured to hold the bleed valve in the open position when the front support is in one or more of the intermediate positions.

7. The nozzle assembly of claim 3, wherein the height adjustment mechanism comprises a carriage pivotally mounted to the nozzle assembly to rotate about a longitudinal axis, and the front support is operatively connected to a free end of the carriage.

8. The nozzle assembly of claim 7, wherein the front support comprises at least two wheels.

9. The nozzle assembly of claim 7, wherein the carriage comprises one or more lever arms configured to pivot with the carriage, the one or more lever arms being positioned to hold the bleed valve in the open position when the front support is in the second position.

10. The nozzle assembly of claim 7, wherein the bleed valve is pivotally mounted to rotate about the longitudinal axis.

11. The nozzle assembly of claim 10, wherein the bleed valve comprises one or more arced projections that operatively engage the carriage to provide a pivoting support surface between the bleed valve and the carriage.

12. The nozzle assembly of claim 1, wherein the bleed valve comprises a first end, a second end, and a pivoting mount located between the first end and the second end.

13. The nozzle assembly of claim 12, wherein the first end and the second end are generally flush with the suction passage when the bleed valve is in the closed position.

14. The nozzle assembly of claim 13, wherein the pivoting mount is located between the first end and the second end, and the first end is positioned outside the suction passage and the second end is positioned inside the suction passage when the bleed valve is in the open position.

15. The nozzle assembly of claim 1, wherein a side of the bypass opening located outside the suction passage is enclosed by a bleed chamber, the bleed chamber surrounding the bleed valve, and having a bleed chamber air inlet that is inclined relative to the surface to be cleaned.

16. The nozzle assembly of claim 1, wherein the vacuum cleaner comprises an upright vacuum cleaner, and the nozzle assembly comprises a base of the upright vacuum cleaner.

17. The nozzle assembly of claim 1, wherein the vacuum cleaner comprises a canister vacuum cleaner or a central vacuum cleaner, and the nozzle assembly comprises a powerhead of the canister vacuum cleaner or the central vacuum cleaner.

18. A nozzle assembly for use in a vacuum cleaner, the nozzle assembly comprising:

an inlet opening;

a height adjustment mechanism configured to adjust a vertical position of the inlet opening relative to a surface to be cleaned;

a suction passage fluidly connected to the inlet opening;

a bypass opening fluidly connected to the suction passage;

a bleed valve comprising a closed position in which the bleed valve blocks the bypass opening, and an open position in which the bleed valve does not block the bypass opening to allow a flow of air through the bypass opening and into the suction passage, the bleed valve being operatively connected to the height adjustment mechanism and configured to move from the closed position to the open position in response to an adjustment of the height adjustment mechanism, wherein the height adjustment mechanism comprises a front support configured to rest on the surface to be cleaned, the front support being movable between a first position in which the front support holds the inlet opening at a first distance from the surface to be cleaned, and a second position in which the front support holds the inlet opening at a second distance from the surface to be cleaned, the second distance being greater than the first distance, and wherein the height adjustment mechanism is configured to move the bleed valve to the closed position or allow the bleed valve to be in the closed position when the front support is in the first position, and to hold the bleed valve in the open position when the front support is in the second position; and a resilient member operatively connected to the bleed valve and configured to bias the bleed valve to the closed position when the front support is in the first position.

19. A vacuum cleaner comprising:

a vacuum fan;

an inlet opening fluidly connected to the vacuum fan;

a dirt separation device configured to receive and clean a flow of dirt-laden air from the inlet opening;

a height adjustment mechanism configured to adjust a vertical position of the inlet opening relative to a surface to be cleaned;

a suction passage fluidly connected to the inlet opening;

a bypass opening fluidly connected to the suction passage;

a bleed valve comprising a closed position in which the bleed valve blocks the bypass opening, and an open position in which the bleed valve does not block the bypass opening to allow a flow of air through the bypass opening and into the suction passage, the bleed valve being operatively connected to the height adjustment mechanism and configured to move from the closed position to the open position in response to an adjustment of the height adjustment mechanism; and a resilient member configured to bias the bleed valve to the closed position.

20. A vacuum cleaner comprising:

a vacuum fan;

an inlet opening fluidly connected to the vacuum fan;

a dirt separation device configured to receive and clean a flow of dirt-laden air from the inlet opening;

a height adjustment mechanism configured to adjust a vertical position of the inlet opening relative to a surface to be cleaned;

a suction passage fluidly connected to the inlet opening;

a bypass opening fluidly connected to the suction passage;

a bleed valve comprising a closed position in which the bleed valve blocks the bypass opening, and an open position in which the bleed valve does not block the bypass opening to allow a flow of air through the bypass opening and into the suction passage, the bleed valve being operatively connected to the height adjustment mechanism and configured to move from the closed position to the open position in response to an adjustment of the height adjustment mechanism, wherein the height adjustment mechanism comprises a front support configured to rest on the surface to be cleaned, the front support being movable between a first position in which the front support holds the inlet opening at a first distance from the surface to be cleaned, and a second position in which the front support holds the inlet opening at a second distance from the surface to be cleaned, the second distance being greater than the first distance, and wherein the height adjustment mechanism is configured to move the bleed valve to the closed position or allow the bleed valve to be in the closed position when the front support is in the first position, and to hold the bleed valve in the open position when the front support is in the second position; and a resilient member operatively connected to the bleed valve and configured to bias the bleed valve to the closed position when the front support is in the first position.

* * * * *